US005125725A

United States Patent [19]

Blunt

[11] Patent Number: 5,125,725

[45] Date of Patent: Jun. 30, 1992

[54] TELEVISION SET AND STAND ASSEMBLY

[76] Inventor: Louise Blunt, 8114 Phelps Pl., Forrestville, Md. 20740

[21] Appl. No.: 464,396

[22] Filed: Jan. 12, 1990

[51] Int. Cl.[5] ..... A47B 88/04

[52] U.S. Cl. ..... 312/7.2; 312/250

[58] Field of Search ..... 248/917, 129; 312/250, 312/7.2, 238

[56] References Cited

U.S. PATENT DOCUMENTS 2,605,159 7/1952 Horn ..... 312/7.2
2,808,223 10/1957 Abeles et al. ..... 248/917 X
3,467,455 9/1969 Caldemeyer ..... 312/7.2
3,541,256 11/1970 Anders ..... 312/7.2 X
4,373,761 2/1983 Hansberry ..... 312/250
4,518,208 5/1985 Marder ..... 312/250 X

*Primary Examiner*—Joseph Falk
*Attorney, Agent, or Firm*—John P. Snyder

[57] ABSTRACT

A stand for a television set which has a rectangular pattern of wheels there under and an overhanging rearward portion. The stand has a top surface with a recess for a television and the top is generally T-shaped so a portion underlies the overhanging rearward portion.

10 Claims, 2 Drawing Sheets

TELEVISION SET AND STAND ASSEMBLY

BACKGROUND AND BRIEF SUMMARY OF THE INVENTION

This invention is directed to furniture components in general and in particular to a television set supporting stand and accessory storage device and to the combination of such a stand and a television set.

It is sometimes the case that a television set as obtained from the manufacturer, and this is particularly true of modern large-screen television sets, will rest upon the usual support surface to position the viewing surface of the television screen at a lower position than many people desire. That is, the furniture space of the viewing room may contain furniture pieces which tend to obscure the screen when the viewer is comfortably seated, and the seating arrangements may be such themselves as makes the viewing angle uncomfortable or annoying to some persons.

Accordingly, it is a primary concern of this invention to provide a novel television set/television set stand which renders the television set more pleasing and ornamental than would otherwise be the case.

It is another object of this invention to provide a television set and stand combination as set forth above in which the stand cooperates to locate the set and prevent unwanted and possibly dangerous movement thereof. In this regard, the upper surface of the stand is of T-shape so as to provide a locating recess for the wheel-supported set while at the same time the normally overhanging rearward portion of the cathode ray tube is accommodated and protected by the stand from engaging a wall or similar objects In another aspect, this invention concerns a television set stand which functions also as a storage space particularly for electronic components, such as a VCR, which may be used in conjunction with the television set. For this purpose, the stand is provided with doors giving access to the storage space, and the storage space itself may be provided with internal lighting so as to provide a maximum of usability.

BRIEF DESCRIPTION OF THE DRAWING FIGURES

DETAILED DESCRIPTION OF THE INVENTION

Figure 1:
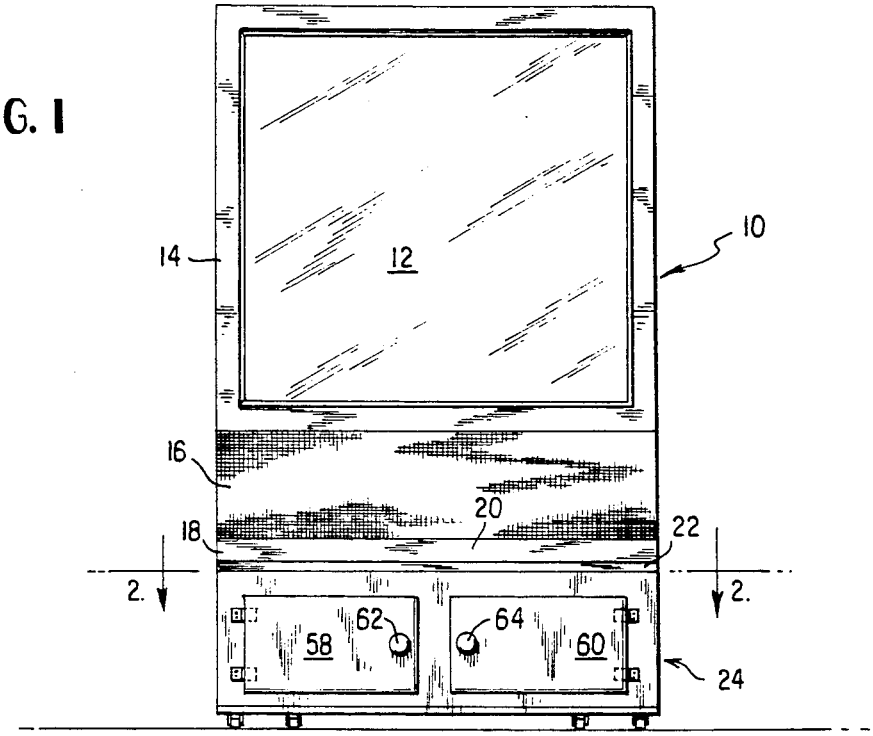
FIG. 1 is a front elevational view of a television set and the stand assembly of this invention.

Referring at this time more particularly to FIG. 1, the reference character 10 indicates in general a television set of large screen size, the viewing surface 12 of the screen being surrounded by an appropriate frame work 14 and there being provided the usual network or grille 16 there below, as is usual, and the whole being disposed above the base plate 18. The base plate is provided with a sloped surface 20 and a vertical surface 22, as shown, and forms the demarcation visually between the television set proper and the stand according to this invention.

Figure 2:
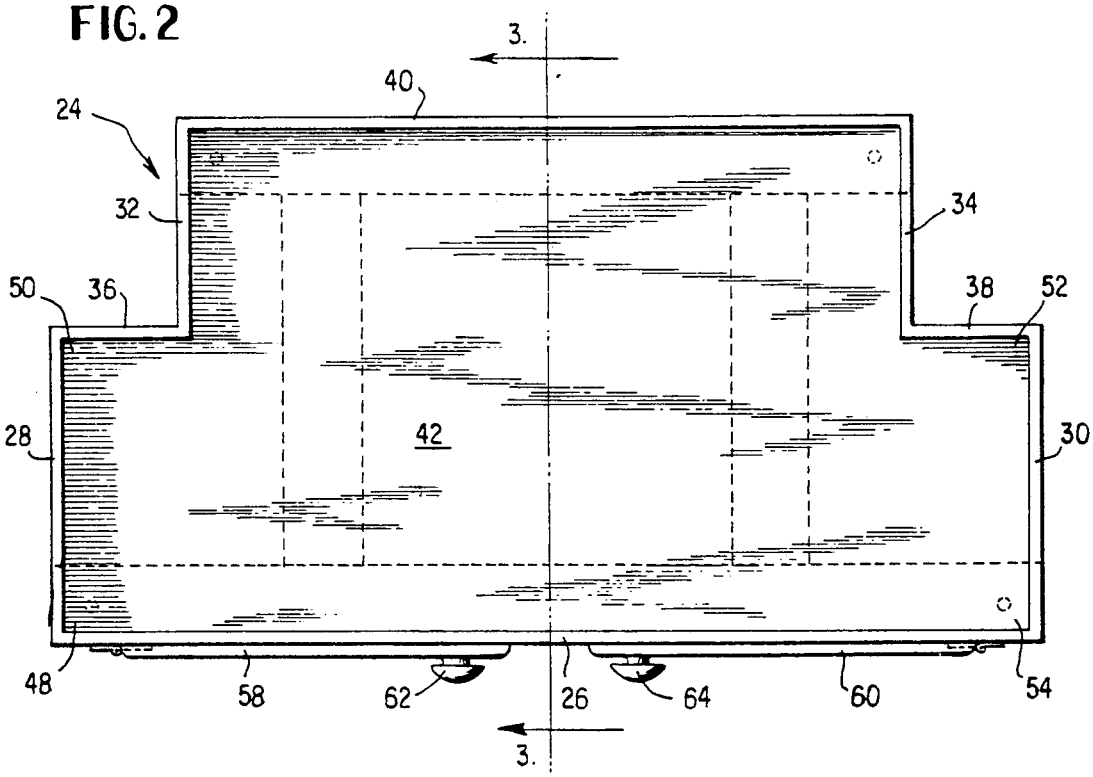
FIG. 2 is an enlarged horizontal section of the stand as taken along the plane of section line 2—2 in FIG. 1.

The stand is indicated generally by the reference character 24 and will be seen to include, as seen in FIG. 2 in particular, the front wall 26, the opposite side walls 28 and 30, the inset opposite side walls 32 and 34, the intermediate rear walls 36 and 38, and the rear wall 40.

Figure 3:
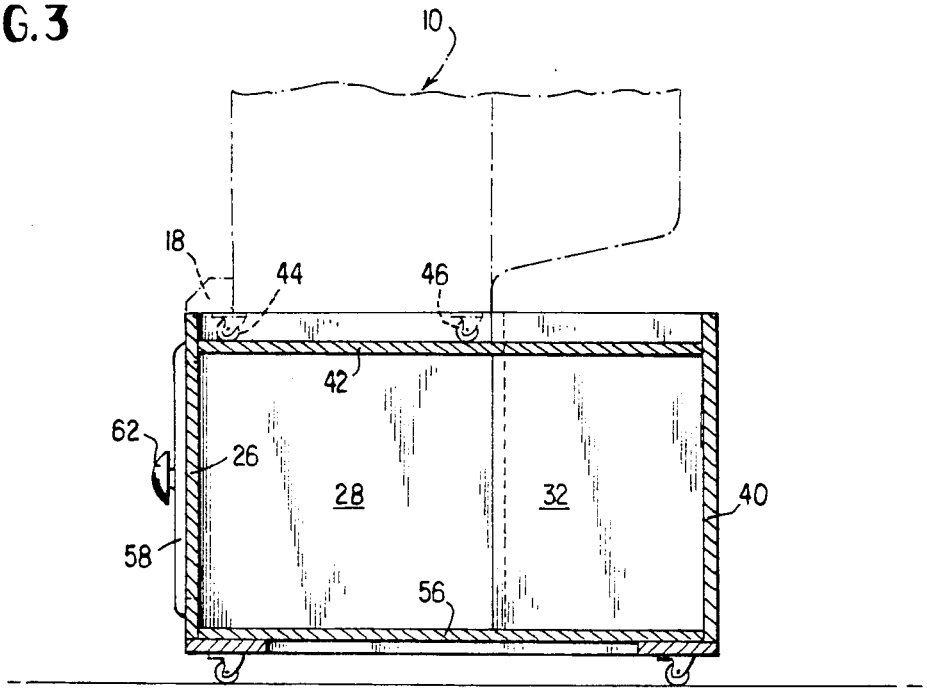
FIG. 3 is a vertical section through the stand taken generally along the plane of section line 3—3 in FIG. 2.

As is shown more clearly in FIG. 3, the top wall 42 of the stand is downwardly recessed with respect to the upper edges of the various walls and is secured peripherally thereto by any conventional technique. The top wall 42 is of T-shaped configuration having a length between the side walls 28 and 30 which is greater than the length between the inset opposite side walls 32 and 34 so as to provide a location recess for the wheels associated with the television set 10. Two of these wheels are illustrated in FIG. 3 and are identified therein by the reference characters 44 and 46. Normally, there will be four of these television set wheels disposed at the corners of the base of the television set. Correspondingly, these wheels are located adjacent the corners 48, 50, 52 and 54 identified in FIG. 2.

Consequently, the television set when nested into the top portion of the stand, on the top wall 42, will be positively located by the recess mentioned so that the various wheels 44 and 46 constrain the television set against gross motion relative to the stand by virtue of the proximity of the wheels 44 and 46 to the front wall 26, side walls 28 and 30 and intermediate rear walls 36 and 38 in the respective corners as aforesaid.

Figure 4:
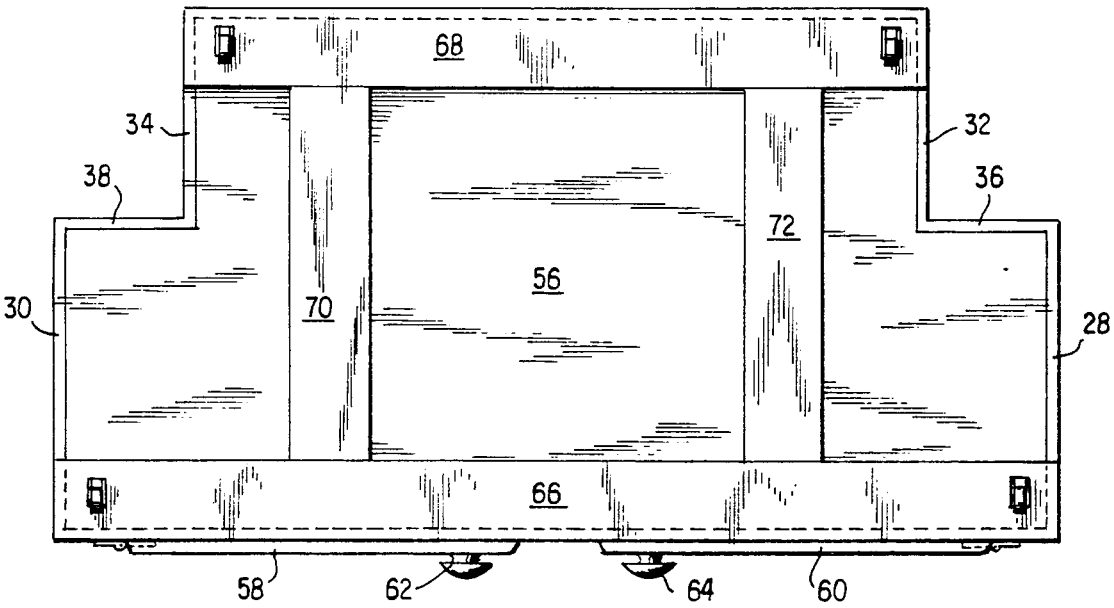
FIG. 4 is a bottom plan view of the stand.

As is shown perhaps most clearly in FIGS. 3 and 4, the stand is also provided with a bottom wall 56, of identical shape to the top wall 42, and cooperating therewith to provide a storage compartment in the stand. The interior of this compartment may be provided with switchable lighting means and the compartment may conveniently house, for example, a VCR and/or stereo components, etc. The front of the compartment is preferably provided with hinged doors 58 and 60 with access handles 62 and 64.

As is shown best in FIGS. 3 and 4, the bottom of the stand assembly is provided with the first transverse support member 66 which marginally overlies the bottom wall 56 and the adjacent bottoms of the front wall 26 and side walls 28 and 30; the second transverse support member 68 which underlies a marginally portion of the bottom wall 56 and the bottoms of the rear wall 40 and the inset 32 and 34 side walls, substantially as is shown. In addition, the first and second cross member 70 and 72 are provided between the support members 66 and 68 to provide a rigidifying support structure for the bottom wall 56.

In considering this invention, the above disclosure is intended to be illustrative only and the scope and coverage of the invention should be construed and determined by the following claims.

What is claimed is:

1. A television set and a television set stand combination which comprises:

a television set having a rectangular pattern of wheel support means underlying a forward portion of the set and having an overhanging rearward portion for accommodating the space necessary for a cathode ray tube for the set, said cathode ray tube having a front viewing surface disposed at the forward portion of the set;

a television set stand underlying the entirety of said television set and elevating said viewing surface to a height substantially greater than the height to which it would be viewed in the absence of said stand, said stand having a top surface defining a locating recess for the wheel support means and locating the television set by virtue of engagement with said wheel support means, said top surface also having a narrowed extension whereby the top surface is of generally T-shape so that the extension underlies said rearward portion of the set and thereby protects it from engagement with objects such as a wall, said television set stand having an accessory space underlying said top surface and a bottom wall of generally T-shape form, and main support wheel means at the corners of said bottom wall.

2. The television set and television set stand as defined in claim 1 including door means for selectively exposing the interior of said accessory space.

3. The television set and television set stand as defined in claim 1 including a first transverse support member underlying said bottom wall at the forward edge thereof and a second transverse support member underlying said bottom wall at the rearward edge thereof, the second support member being shorter than the first support member to accommodate the T-shape of said bottom wall, first and second cross members extending between said transverse members and a T-shaped floor for said accessory space overlying said members.

4. A television set stand for underlying the entirety of a television set to elevate the television set to a height substantially greater than the height to which it would be viewed in the absence of said stand, said stand having a top surface defining a locating recess for the television set and locating same by virtue of engagement therewith, said top surface also having a narrowed extension whereby the top surface is of generally T-shape so that the extension underlies a rearward cathode tube portion of the set and thereby protects it from engagement with objects such as a wall, said television set stand having an accessory space underlying said top surface and a bottom wall of generally T-shape form, and main support wheel means at the corners of said bottom wall.

5. The television set stand as defined in claim 4 including door means for selectively exposing the interior of said accessory space.

6. The television set stand as defined in claim 4 including a first transverse support member underlying said bottom wall at the forward edge thereof and a second transverse support member underlying said bottom wall at the rearward edge thereof, the second support member being shorter than the first support member to accommodate the T-shape of said bottom wall, first and second cross members extending between said transverse members and a T-shaped floor for said accessory space overlying said members.

7. The combination of a wheeled television set stand which is movable over a floor surface and a wheeled television set substantially immovably located by the stand but movable over the floor surface with said stand;

said television set having a rectangular supporting base and a rectangular pattern of four wheel support means at the corners of the supporting base, said set having a cantilevered rearward portion for accommodating the space necessary for a cathode ray tube for the set, said base underlying only a forward portion of the set to the exclusion of said cantilevered rearward portion thereof and there being a front viewing surface disposed at the forward portion of the set;

said television set stand having an elevated top surface underlying the entirety of said television set and elevating said viewing surface to a height substantially greater than the height to which it would be viewed in the absence of said stand, said top surface having a narrowed rearward extension whereby the top surface is of generally T-shape so that the narrowed rearward extension underlies said cantilevered rearward portion of the set and thereby protects it from engagement with objects such as a wall, said stand having upstanding side wall means surrounding said top surface and defining four locating corners, said locating corners being mutually inwardly facing so as to define four corners of a locating recess for the respective four wheel support means and locating the television set relative to the stand by virtue of receiving said wheel support means, said television set stand having an accessory space underlying said top surface and being provided with a bottom wall, and main support wheel means at the corners of said bottom wall.

8. The television set and television set stand as defined in claim 7 wherein said bottom wall is of said T-shape and including a first transverse support member underlying said bottom wall at the forward edge thereof and a second transverse support member underlying said bottom wall at the rearward edge thereof, the second support member being shorter than the first support member to accommodate the T-shape of said bottom wall, first and second cross members extending between said transverse members and a T-shaped floor for said accessory space overlying said members.

9. The combination as defined in claim 7 wherein said upstanding side wall means includes four end-connected walls, all of the same height and such height being substantially greater than the height of the four wheel support means and a base plate at the front lower edge of the set so that said wheel support means are hidden from view.

10. A television set and television set as defined in claim 1 wherein said locating recess is bounded by four end-connected upstanding walls defining corners nesting said wheel support means, said four walls being the same height and such height being substantially greater than the height of the wheel support means and a base plate at the front lower edge of the set so that said wheel support means are hidden from view.

* * * * *